United States Patent [19]

Zoiss

[11] 3,972,161

[45] Aug. 3, 1976

[54] SOLID ABRADING TOOL WITH FIBER ABRASIVE

[75] Inventor: Melvin Howard Zoiss, Oaklawn, Ill.

[73] Assignee: Barnes Drill Co., Rockford, Ill.

[22] Filed: Oct. 16, 1969

[21] Appl. No.: 868,976

Related U.S. Application Data

[63] Continuation-in-part of Ser. No. 741,718, July 1, 1968, abandoned.

[52] U.S. Cl. ..... 51/206 R; 29/103 R; 51/309 R

[51] Int. Cl.[2] ..... B24D 3/00

[58] Field of Search ..... 51/206, 338, 309, 209; 15/179; 29/103

[56] References Cited

UNITED STATES PATENTS

| | | | |
|---|---|---|---|
| 1,913,373 | 6/1933 | Golyer | 29/95 X |
| 2,189,340 | 2/1940 | Donal | 264/24 X |
| 2,232,389 | 2/1941 | Turkat | 51/299 |
| 2,419,136 | 4/1947 | Hasty | 51/338 |
| 2,648,084 | 8/1953 | Swart | 15/DIG. 3 |
| 2,826,016 | 3/1958 | Hurst | 51/206 |
| 2,973,539 | 3/1961 | Buehrle | 15/179 |
| 3,256,644 | 6/1966 | Kistler | 51/206 |
| 3,372,220 | 3/1968 | Stingley | 15/179 X |
| 3,440,907 | 4/1969 | Wrench | 76/24 R |
| 3,495,960 | 2/1970 | Schladitz | 51/309 X |
| 3,619,152 | 11/1971 | Falof | 51/309 |

FOREIGN PATENTS OR APPLICATIONS

| | | | |
|---|---|---|---|
| 500,852 | 2/1939 | United Kingdom | 15/179 |
| 2,009 | 1/1907 | United Kingdom | 51/206 |

*Primary Examiner*—Harold D. Whitehead
*Attorney, Agent, or Firm*—Leydig, Voit, Osann, Mayer & Holt, Ltd.

[57] ABSTRACT

Abrading tools having shaped solid bodies composed of wearable matrix material and embedded fibers of harder abrasive material with ends exposed at the working surfaces of the tools and constituting the abrasive or cutting elements of the tools. In one case, a honing stone has closely spaced cylindrical fibers arranged in rows of fibers substantially perpendicular to the working face, which has a slight transverse curvature, and alternate arrangements inclined relative to the face so that the ends are oval. In another case, an abrading wheel has radial fibers and another has longitudinal fibers for end-working applications. Suitable fiber materials for machining metals may be boron and boron compounds.

4 Claims, 11 Drawing Figures

INVENTOR
Melvin Howard Zoiss by Wolfe, Hubbard, Voit & Osann
ATTORNEY

INVENTOR
Melvin Howard Zoiss by Wolfe, Hubbard, Voit & Osann
ATTORNEYS

SOLID ABRADING TOOL WITH FIBER ABRASIVE

CROSS-REFERENCE TO RELATED APPLICATION

This application is a continuation-in-part of my copending application Ser. No. 741,718, filed July 1, 1968, and now abandoned.

BACKGROUND OF THE INVENTION

This invention relates to abrading tools generally and, more specifically, to the construction of honing stones, grinding wheels, abrasive cut-off wheels and the like, with particular reference to the configuration, composition and arrangement of abrasive elements therein. The typical conventional abrasive tool comprises a body of matrix material that is shaped according to the particular abrading operation that is to be performed, with abrasive grains or grit interspersed through and held by the matrix material to provide a wearable abrasive face on at least one side of the body, Conventional granular abrasives may be either natural or synthetic materials and include silicon carbide, aluminum oxide (both in natural and synthetic forms), boron carbide, garnet, silica and diamond, the latter being quite expensive and used primarily in chip or dust form for special applications.

With grains of such material mixed throughout a relatively hard, wearable matrix material, the working face of the stone or wheel comprises a large number of grits embedded in the matrix and partially exposed for abrading contact with a workpiece. During rubbing contact with the work, each exposed particle abrades the work and is itself consumed, either by gradual wearing, by fracturing to expose new abrading surfaces, or by breaking loose from the matrix material and being lost from the tool when the amount of the particle embedded in or bonded to the matrix becomes insufficient to hold the particle, such breaking loose being known as "shelling". At the same time, the surface portion of the matrix material wears away, thus progressively exposing new layers of grit for contact with the work. It will be evident, of course, that the wearing and abrading characteristics of a particular stone or wheel will depend upon the type and size of the grains, the nature of the matrix material, and the pressure with which the tool is pressed against the work, and all of these factors must be considered in the selection of a tool for a given job.

Because of variations in the number of exposed grits at any time, the variable retention of the grit in the matrix material, and the variable abrasive nature of the individual grits, there is a general lack of consistency and, thus, predictability with respect to the precise abrasive performance of a tool at any given instant during an abrading process. In addition, the wear rate often is relatively rapid because of shelling of grits before they have exhausted their abrasive capability, and heat generated during abrading is largely confined to the working surface of the tool, because of the insulating characteristics of the matrix material, often requiring continuous flushing of the work area with coolant during heavy-duty abrading operations to reduce heating of the work and the tool. Despite these and other shortcomings, grit-type abrading tools have been the most practical available tools and are widely used.

SUMMARY OF THE INVENTION

The present invention provides a significantly improved abrading tool that is more consistent in its abrasive and wearing properties than conventional tools, is highly effective both in rough abrading and finishing operations, is capable of removing stock at comparable rates with lower working pressures, thereby reducing heating and distortion of the work as well as the noise accompanying the operation, and is more effective in conducting heat away from the work and the abrading face during the operation. Moreover, where high speeds of tool rotation raise problems of possible disintegration, the abrasive elements themselves are used as effective reinforcing elements, thereby eliminating the need for special reinforcement. In short, the invention is believed to be a significant advance in the abrading art.

For the foregoing purposes, the tool comprises a shaped and relatively rigid body of wearable matrix material having at least one working face for engagement with the workpiece to be abraded, and abrading elements in the form of elongated fibers of selected harder material disposed within the body and extending transversely of the working face with ends of the fibers exposed at the face for abrading engagement with the work, and with the remainder of each fiber extending inwardly through the body and securely anchored therein to brace and back the abrasive ends against bending and breaking off prematurely during the abrading operation. The particular material selected for the fibers depends upon the hardness of the material of the work and is substantially harder than the work. For optimum abrading consistency and effectiveness, the fibers are closely spaced and arranged within the matrix to provide and maintain general uniformity in the pattern of the exposed ends, both initially and as the tool wears away, and all of the fibers are oriented to extend inwardly from the working face of the tool, preferably substantially parallel to each other. In addition, the invention contemplates the inclination of the fibers relative to the direction of tool motion to vary the shape of the end abrading surfaces presented to the work, thereby making it possible to vary the abrasive characteristics obtained with fibers of given size and shape.

Other objects and advantages of the invention will become apparent from the following detailed description, taken in conjunction with the accompanying drawings.

DETAILED DESCRIPTION OF THE PREFERRED EMBODIMENT

Figure 1:
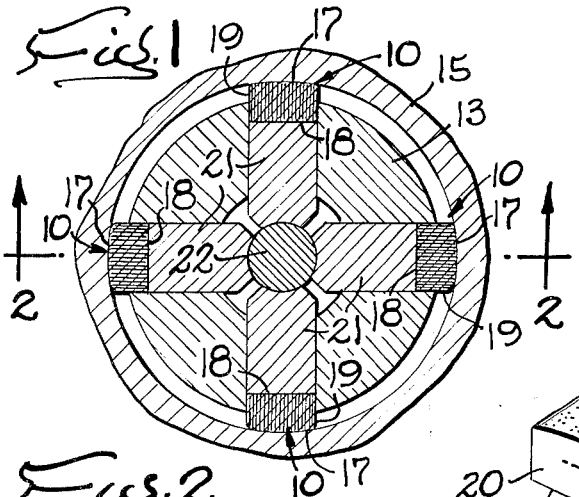
FIG. 1 is a fragmentary cross-sectional view taken in a transverse plane through a hone equipped with honing stones embodying the novel features of the present invention, the view being taken substantially along the line 1—1 of FIG. 2 and showing the hone in enlarged scale in operative engagement with the wall of a bore in a workpiece.

As shown in the drawings for purposes of illustration, the invention is embodied in honing sticks or stones 10 (FIGS. 1–8) and grinding wheels 11 and 12 (FIGS. 9–11) that are representative of different types of abrading tools with which the present invention may be used. As is well known in the art, the typical honing operation uses a set of honing stones spaced around a tool body 13 (FIGS. 1 and 2) and fed progressively outwardly into a generally cylindrical internal wall 14 of a workpiece 15 while the tool body is simultaneously rotated within and reciprocated along the workpiece. This maintains the outer working face 17 of each stone 10 in engagement with the wall 14 under selected honing pressure to abrade and finish the wall. At the same time, the face 17 wears away at a rate determined by the relative properties of the work material and the tool materials as well as the manner of application of the tool to the work, including the working pressure and the rate of motion relative to the wall.

The honing stones 10 shown herein are generally rectangular in cross-section and have elongated, generally flat working faces 17 which preferably are formed with a slight transverse curvature to conform more readily to the curvature of the work surface, each face of the several stones being a surface of revolution and part of a common cylinder. The inner face or back 18 of each stone is flat, as are the sides 19 and the ends 20, and each stone typically is mounted on a carrier (not shown) of relatively soft metal or plastic that may take various forms well known in the art.

Figure 2:
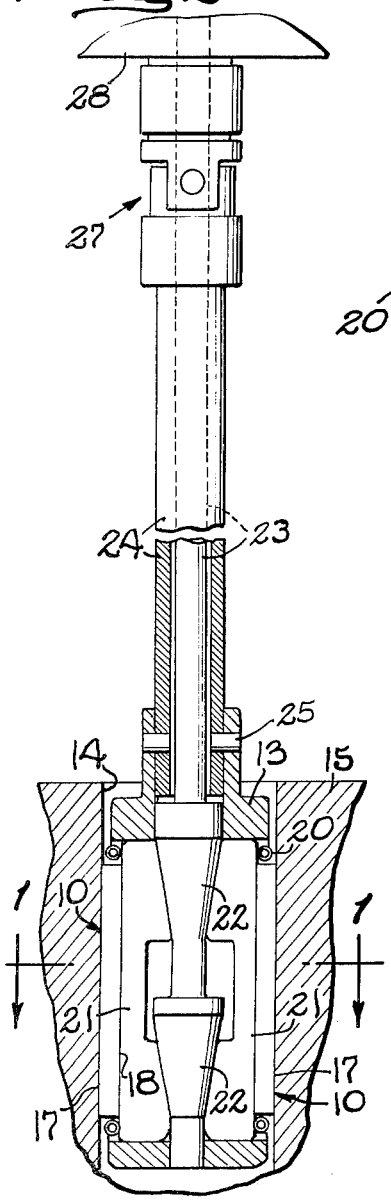
FIG. 2 is a fragmentary side elevation of the hone in FIG. 1, together with part of its supporting and driving mechanism, parts of the hone and the associated workpiece being shown in cross-section.

As shown in FIGS. 1 and 2, four stones are equally spaced around the hone body 13 and fitted in longitudinal slots therein with the backs 18 of the stones in engagement with followers 21 formed with inclined surfaces riding on conical cams 22 supported on a rod 23 extending upwardly through a hollow shaft 24 pinned at 25 to the hone body and coupled at the other end at 27 to the rotary drive and reciprocating head 28 of the machine. With this arrangement, the hone is simultaneously rotated in and reciprocated along the work bore while the rod 23 is shifted progressively downwardly at a selected rate within the shaft 24 to push the stones progressively outwardly relative to the hone body, thereby maintaining the desired abrading pressure on the work as the wall 14 wears away and the bore is enlarged.

Figure 9:
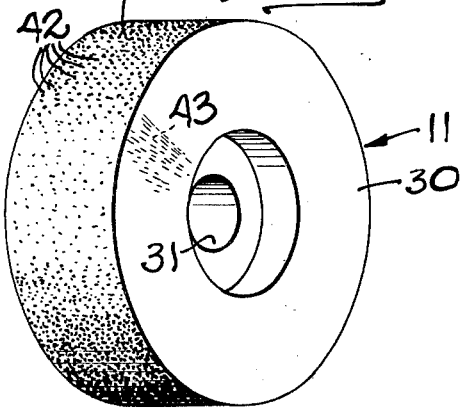
FIG. 9 is a perspective view of a grinding wheel having fiber ends exposed at its peripheral surface.
Figure 11:
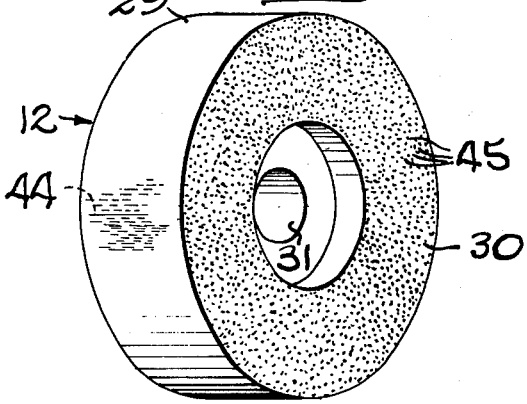
FIG. 11 is a view similar to FIG. 9 showing a wheel with fiber ends exposed at the side or end surface of the wheel.

For abrading operations of the type referred to in the trade as grinding or abrasive cut-off operations, the tool is a disk, as shown in FIGS. 9 and 11, having a peripheral surface 29 of circular cross-section and usually flat side or end surfaces 30, the periphery being the working surface in some instances and the ends 30 being working surfaces in other instances, depending upon the type and shape of workpiece to be abraded. A center hole 31 is formed in the disk to receive a drive shaft (not shown) for rotating the tool as the work is fed relative thereto in contact with a working surface. The disk 11 represents a grinding wheel intended for grinding with the periphery 29, and the disk 12 is an end-working wheel.

As previously suggested, a conventional abrading tool typically comprises granular abrasive particles such as aluminum oxide or silicon carbide grains bonded together by a matrix such as vitrified, silicate, shellac, rubber or synthetic resin materials, with a selected size of abrasive grain and a selected hardness and strength of matrix material for a particular job to be performed. The abrasive grains are distributed as uniformly as possible throughout the stone or wheel so that the working surface is made up of exposed grains embedded in the matrix for abrading engagement with the work as the tool is pressed against and moved relative to the work surface.

During abrading with any such tool, each exposed grain rubbing against the work surface cuts or scratches the surface to an extent depending primarily upon the sharpness, hardness and size of the grain and upon the abrading pressure exerted on the work. At the same time, the active grains themselves wear away, sometimes fracturing to expose new cutting edges, and eventually break loose from the matrix material, hopefully only after the major portion of the grain has performed its intended abrading function and is substantially worn away, but sometimes prematurely when the bond between the grain and the matrix fails. Such failure may occur as a result of excessive abrading pressure which drags and pulls grains out of the matrix, or perhaps as a result of excessive heating of the grains and the contiguous matrix material, or perhaps as a result of an imperfect bond between the grains and the matrix. In any event, the drag on the particle becomes greater than the holding force of the bond as the particle wears and becomes smaller. Of course, the matrix material also wears away to expose new particles and renew the abrasive working surface as the tool wears down.

In accordance with the present invention, the abrading elements of the improved tools 10, 11 and 12 are in the form of elongated fibers or filaments composed of material appreciably harder than the work and having substantially uniform cross-sectional thickness, and are embedded in solid and relatively rigid matrix material with ends of fibers at the working face of the tool for engagement with the work surface and with the remainders of the fibers extending inwardly into the matrix, transversely of the working face, and securely anchored and braced against bending, breaking off, or pulling out of the tool. As will become apparent, the action of the fibers may aptly be described as micromachining and, as used herein, the term "abrading" contemplates micromachining as well. While a random disposition of chopped fibers will result in an abrading tool that is satisfactory for some purposes, optimum abrading performance and consistency of operation are achieved by arranging the fibers in the tool to provide uniformity of spacing of the abrading ends at the working face with each fiber extending inwardly at a selected angle relative to the face and generally parallel to the other fibers, thereby providing a pattern of abrading elements that is substantially uniform at all levels within the tool.

It has been demonstrated that the use of selected high-hardness abrasive materials in fiber form, and the anchoring of such fibers in a three-dimensional arrangement in solid matrix material to prevent bending, result in a tool of extremely high abrasive effectiveness, because of improved retention of the anchored abrasive elements in the tool and improved rake angle the filamentary elements present to the workpiece. The controlled pattern of abrasive elements and the increased consistency of each individual element combine to make the tool consistent at all abrading levels. With parallel, inwardly extending elements arranged in an array or pattern, several other advantages are obtained. One of these is the greatly improved conduction of heat away from the work surface through the continuous paths formed by the abrading elements. Another is the reinforcing of the matrix by the abrasive elements themselves, thus eliminating the need for special fabric or fiber reinforcement in high-speed rotary tools. These and other advantages make the abrading tool of the present invention significantly better in many ways than presently available conventional tool. As used herein, the term "fiber" should be interpreted as meaning an elongated thread-like or flat ribbon-like element of generally uniform and regular cross-section and having a length on the order of about twenty times the thickness, although much greater lengths often will be used.

Figure 4:
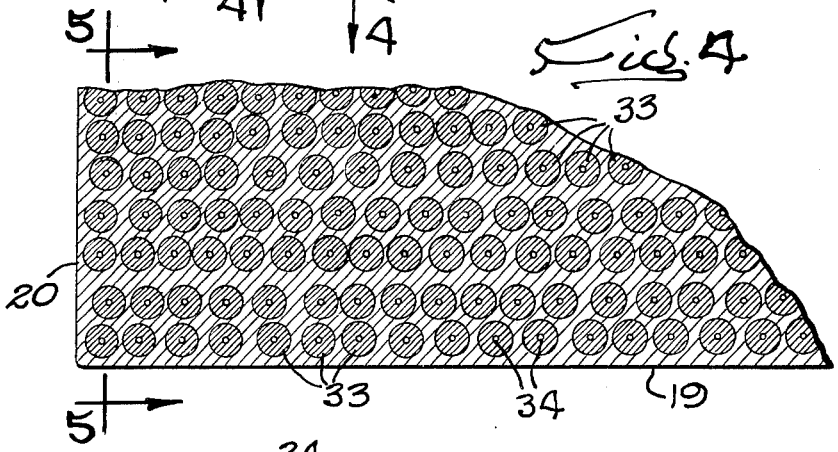
FIG. 4 is a greatly magnified fragmentary cross-sectional view taken substantially along the line 4—4 of FIG. 3 and showing the cross-sectional shape and relationship of abrasive elements in the stone.
Figure 5:
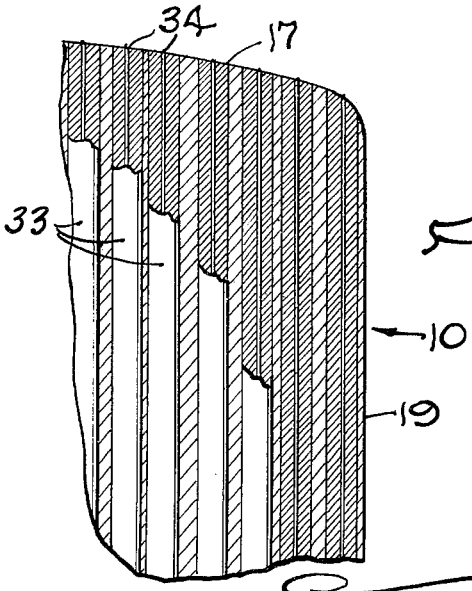
FIG. 5 is a magnified fragmentary cross-sectional view taken substantially along the line 5—5 of FIG. 4, longitudinally of the elements.

As shown in FIGS. 4 and 5, the representative honing stone 10 has the usual shape and is made up of a large number of longitudinal rows or layers of parallel abrasive fibers 33, each herein having a circular cross-section and being generally perpendicular to the working face 17 (ignoring the transverse curvature) and parallel to the sides 19 of the stone. The spacing of the fibers in each longitudinal row is generally uniform, and the spacing between adjacent rows is similar, but these spacings may vary in practice as a result of different manufacturing techniques used. Alignment of corresponding fibers transversely of the stone is to be avoided in order to eliminate transverse "blank" lines of matrix material that would produce inactive areas completely across the stone. Thus, the layers of fibers are longitudinally staggered in a random manner.

The particular material used for the fibers depends upon the material of the workpiece, that is, the fibers must be harder than the work and the difference in hardness should be at least 250 as measured on the Knoop scale. Of course, a greater differential usually will produce faster abrading and, thus, the material chosen in each case depends upon the cost of the material as compared with the degree of improved abrading action. While different sizes of fibers 33 may be used, two repesentative sizes that presently are commercially available are diameters of 0.004 of an inch and 0.008 of an inch. Thus, assuming FIGS. 4 and 5 are representations of fibers having a diameter of 0.004 of an inch, it will be seen that the degree of magnification is 40–50 times actual size. Where the work is iron or steel, a comparatively hard material should be used for the fibers and, while various hard abrasive materials may be, or become, available in fiber form, the preferred material is boron fiber which presently is supplied by manufacturers for use in structurally reinforced materials, particularly in the aircraft industry. One of the manufacturers is United Aircraft.

Figure 8:
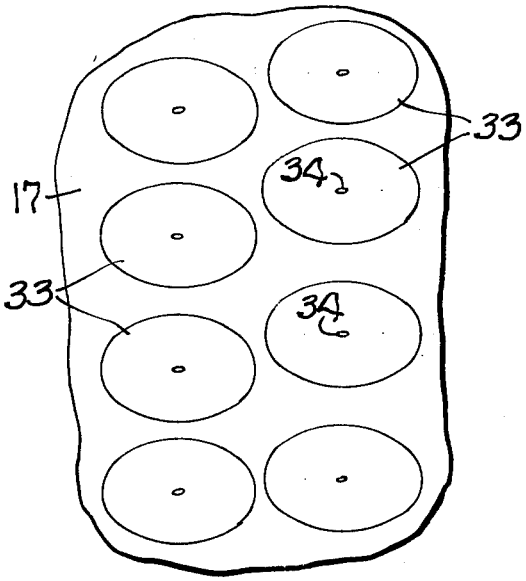
FIG. 8 is an enlarged fragmentary plan view illustrating the configuration of the end surface of the fibers in FIGS. 6 and 7.

In one form, such fiber is produced by vapor deposition of boron on a 0.0005 of an inch tungsten filament which remains in the center of the fiber as a core 34 (FIGS. 4 and 8). Such boron fibers have a hardness approaching that of diamond (7000 Knoop hardness with 100 gram loading), but the hardness value has not been susceptible of precise measurement because of the closeness to the hardness of diamond.

Thus, this presently preferred material has the recognized advantage of high hardness and, in addition, the generally regular cross-sectional shape and size which are characteristics of fibers and which, when combined with a hard, wearable matrix material anchoring the abrading elements securely in the tool, produce the improved abrading tool of the present invention. For structural applications, it can be important to hold the fibers within close property tolerances, thickness and shape. When the fibers are to be used as abrasive elements, however, there is no need for close quality control and the manufacturing costs may be considerably lower if considerable variation in thickness is permitted.

In addition to boron, other candidate fiber materials, with comparative Knoop hardness ratings, are the following:

| | |
|---|---|
| Boron nitride | (not recorded) |
| Boron carbide | 2750 |
| Silicon carbide | 2480 |
| Titanium carbide | 2470 |
| Alumina (aluminum oxide) | 2100 |
| Tungsten carbide | 1880 |
| Zirconia | 1160 |

In addition, titanium diboride, silica-substrate boron, and various combinations of the foregoing materials will serve the purposes of the present invention. In abrading soft materials such as brass, the fibers may be made of steel. It may be stated generally that the abrasive characteristics of materials increase with the hardness of the material, and that boron and certain of its compounds are the preferred materials for use as abrasive fibers, some of these materials already having been used in granular form in conventional tools. Although not an invariable requirement, useful abrasive materials normally should have a hardness above 1000 Knoop measurement. Toughness, strength, and fracture characteristics also are known variables that influence the abrasiveness of different materials and are factors already considered by those skilled in the art in the selection of a granular abrasive material for a particular application.

With respect to the selection of matrix materials, it will be sufficient to state that conventional materials may be used. For optimum performance, the material should be tough and should wear away to maintain the exposure of fiber ends for engagement with the work without excessive breaking away behind the fibers, and should prevent excessive bending of the fibers in contact with the work to avoid breaking off of the fibers inside the tool. Polyimide materials and epoxies such as epoxy novolac have been shown to be satisfactory for these purposes. While high-temperature resistance is necessary, the improved heat-conducting characteristics of the tools makes this factor somewhat less critical than it has been in some conventional tools.

Figure 3:
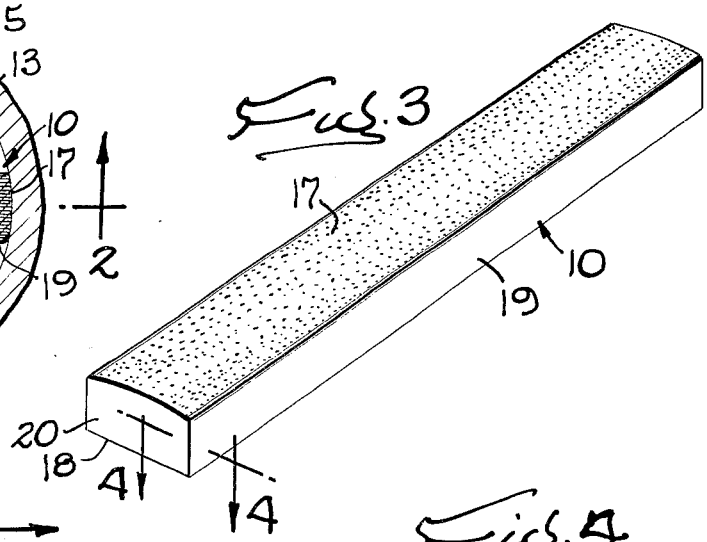
FIG. 3 is an enlarged perspective view of one of the honing stones.

To form a stone 10 of the type shown in FIGS. 3 and 4, side-by-side rows or layers of fibers 33 of selected length may be stacked together in a mold, impregnated with matrix material in liquid form, and cured into the solid block shown in the drawings. The layers may be fabricated in a manner presently known, for example, by winding a continuous strip of fiber from the usual supply roll onto a drum while traversing the strip along the drum to lay adjacent convolutions in closely spaced relation. Prior to the winding, the strip may be covered with a coating of resin, and the drum may be covered with a layer of fabric such as glass cloth to which the coated strip adheres and which subsequently forms a backing facilitating handling of the strip. After one layer is so wound, it may be cut longitudinally for removal from the drum as a sheet of parallel fibers spaced according to the rate of traverse during winding. A stack of small pieces cut or sheared from the sheet then may be impregnated and cured, with or without pieces of glass cloth between adjacent layers.

Another method is to wind a resin-coated continuous fiber strip onto a flat-sided rotary drum having arcuate side portions wide enough to avoid breakage, and to traverse the strip back and forth for a multiple-layer sheath on the drum. After curing of the resin, the flat side portions of the sheath constitute plates from which honing stones may be cut.

Figure 6:
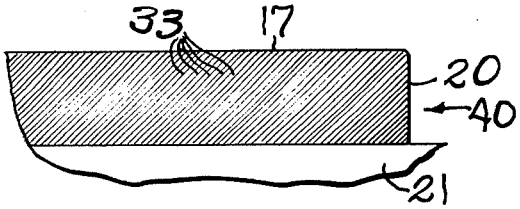
FIG. 6 is a fragmentary side elevational view of a honing stone illustrating an alternative arrangement of fibers in the stone, the fibers being shown with a somewhat exaggerated spacing.
Figure 7:
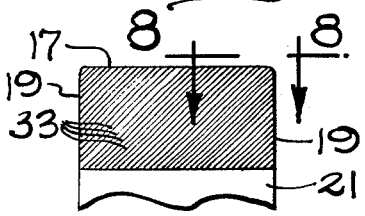
FIG. 7 is an end view of still another honing stone with a second alternative arrangement of the fibers.

Alternative arrangements of the fibers in honing stones 40 and 41 are illustrated in FIGS. 6–8, wherein it will be seen that inclining the fibers 33 relative to the working face 17 and the direction of abrading motion produces changes in the size and shape of the exposed ends of the abrading elements. With cylindrical fibers perpendicular to the working face as in FIGS. 4 and 5, the ends are circular. On the other hand, when the fibers are inclined, the ends are oval in shape (FIG. 8) and the degree and direction of incline respectively change the amount of elongation of the oval and the relation of such elongation to the direction of abrading motion. Fibers of other cross-sectional shape will produce correspondingly shaped ends.

As an example, FIG. 7 illustrates the inclination of the fibers 33 inwardly through the tool and rearwardly from the exposed ends, and the latter have the oval shape shown schematically in FIG. 8 with the long axis of the oval perpendicular to the long axis of the tool and parallel to the direction of abrading motion. The short axis of the oval is equal to the diameter of the fiber, but the long axis is substantially longer than the diameter. As a result, it will be seen that the effective thickness of a given size of fiber and the shear angle at which the leading edge engages the work may be varied by changing the angle of the fiber.

In FIG. 6, the fibers are inclined inwardly through, and toward one end of, the tool, and this results in oval end surfaces in which the long axis is perpendicular to the direction of motion and extends longitudinally of the stone. This varies the effective width of the abrading elements, according to the angle of the fibers, to produce different controlled abrading characteristics with a given diameter of fiber. Accordingly, these versatile tools may be tailor-made to suit particular jobs with a minimum of different sizes and types of fibers.

Figure 10:
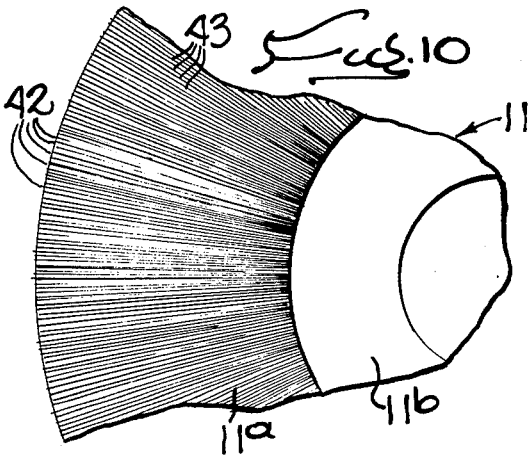
FIG. 10 is a fragmentary end view of the wheel in FIG. 9, on an enlarged scale.

The wheel 11 shown in FIGS. 9 and 10 illustrates a preferred arrangement of fibers for a wheel in which the periphery 29 is to be used as the working face. In this instance, each fiber extends radially of the wheel, generally parallel to the adjacent fibers and perpendicular to the curved face 29 in a wheel of substantial diameter, so that each fiber has an end 42 exposed at the periphery for abrasive contact with the work and extends inwardly a substantial distance into the wheel. Fibers of different lengths may be used, and the arrangement may be such that only a peripheral band $11^a$ has the full concentration of fibers, as illustrated in FIG. 10. The central, core area $11^b$ seldom is used for abrading purposes, and thus need not have abrasive fibers. The fibers 43 in a tool such as this may be formed initially in narrow sheets or tapes of parallel fibers and positioned by hand in a mold before curing, or may be formed by hand into disks including fabric backings on which radial fibers are positioned by hand.

This arrangement of fiber abrasive elements 43 serves a very important additional function in abrasive wheels designed for high-speed, heavy-duty abrading such as an abrasive cut-off operation where the high speeds of rotation create centrifugal forces tending to destroy the wheel, a problem that becomes particularly acute and dangerous if the wheel becomes unbalanced as a result of a notch or a nick. In the past, it has been necessary to reinforce such wheels with fabric such as fiber glass to guard against wheel disintegration under such circumstances. Here, however, the abrasive elements themselves are radial fibers that tie the wheel together and thus eliminate the need for additional reinforcement. Where the principal lines of force can be identified, fibers may be arranged in the tool along those lines for optimum reinforcement. Although fibers are not needed in the core area $11^b$ for abrading purposes, some of the fibers may be extended into this area for reinforcing purposes.

The wheel 12 in FIG. 11 illustrates the preferred fiber orientation for use of the end or side surfaces 30 of the wheel as the working face or faces. In this case, the fibers 44 extend transversely through the wheel, generally longitudinally of the wheel axis, and the opposite ends 45 of each fiber are exposed at the flat end surfaces. Of course, these fibers also may be inclined relative to the end surfaces to vary the shape of the abrading end surfaces, just as in the case of the fibers in honing stones. These fibers do not, however, provide the radial reinforcement obtained in the wheel shown in FIG. 9.

An important aspect of the improved tools, previously mentioned in passing, is the enhanced heat transfer from the cutting interface between the abrasive elements and the work. The power dissipated at the interface is converted into heat, part of which is transferred to the workpiece, part to the tool, and the remainder to the air and the coolant, if a coolant is used. Excessive heating of the workpiece causes distortion and thus raises difficulties in holding the work surface to close tolerances, particularly in honing, and excessive heating of the tool is believed to contribute to failure of the bond between the matrix and conventional abrasive particles. Most matrix materials are relatively good thermal insulators, so the heat in the tool is concentrated in the abrasive near the surface.

The thermal conductivities of different hard abrasive materials and matrix materials vary, of course, but the abrasives, generally, have much higher conductivities than the matrix materials. Boron compounds, for example, have coefficients of conductivity on the order of thirty times greater than resinoid matrix materials. Accordingly, by providing continuous heat-conducting fibers extending through the tool, the rate of heat transfer away from the working face is greatly increased. In other words, the fiber abrasive elements also are utilized as continuous heat transfer elements for carrying the heat away from the working face toward the opposite side of the tool, where there usually is a metal mounting element that often is cooled for full and rapid removal of heat. Of course, the reduced working pressures made practical with tools embodying the present invention result in less heat generation, further enhancing the temperature-maintenance situation. The reduced pressure requirement and the reduced heating characteristic combine to make the tools well suited for relatively delicate and precise work situations.

From the foregoing, it will be seen that the present invention constitutes a significant advance in the abrading art which increases the life, consistency and effectiveness of abrading tools, makes possible the use of lighter abrading pressures, and improves the capability of the tool to conduct heat away from the work. Moreover, the novel tool is versatile from the standpoint of varying the abrading characteristics of a given size of fiber, and utilizes the abrading elements themselves as effective structural reinforcement for high-speed applications.

I claim:

1. A superindurate composite cutting and abrading material for application to very hard substances, comprising in combination:

a. a matrix material having the characteristics of toughness and a uniform wearability less than the abrading elements embedded therein:

b. a plurality of superindurate filaments having a hardness on the Mohs' scale of 9.3 to 9.6 aligned substantially normal to a work surface defined by said matrix and collocated within said matrix the ends of substantially the major portion of said filaments exposed on said surface to define a cutting edge of abrading surface upon said composite, the remainder of the length of said filaments embedded in said matrix.

2. A boron composite tool comprising:

a supporting body, a cutting edge at the outer portion of said body, and said cutting edge comprising a boron filament composite.

3. The boron composite cutting tool as set forth in claim 2 wherein:

said supporting body comprises a mandrel of fiberglass.

4. The boron composite cutting tool as set forth in claim 2 wherein:

said supporting body comprises a boron filament fiberglass matrix composite.

* * * * *